United States Patent [19]

Sakuma et al.

[11] 4,077,199

[45] Mar. 7, 1978

[54] SMALL SIZED ELECTRONIC TIMEPIECE MOVEMENT

[75] Inventors: Tadashi Sakuma; Masatoshi Hanaoka, both of Tokyo, Japan

[73] Assignee: Kabushiki Kaisha Daini Seikosha, Japan

[21] Appl. No.: 723,530

[22] Filed: Sep. 15, 1976

[30] Foreign Application Priority Data

Sep. 16, 1975 Japan ..... 50-127043

[51] Int. Cl.[2] ..... G04C 3/00; G04B 37/04

[52] U.S. Cl. ..... 58/23 BA; 58/53; 58/59; 58/88 R

[58] Field of Search ..... 58/23 R, 23 BA, 23 C, 58/23 TF, 23 D, 50 R, 52–55, 59, 88 R

[56] References Cited

U.S. PATENT DOCUMENTS

| | | | |
|---|---|---|---|
| 2,900,786 | 8/1959 | Hetzel | 58/23 TF |
| 3,052,082 | 9/1962 | Beyner et al. | 58/23 R |
| 3,628,323 | 12/1971 | Baumgartner et al. | 58/23 BA |

FOREIGN PATENT DOCUMENTS

| | | | |
|---|---|---|---|
| 908,419 | 10/1962 | United Kingdom | 58/23 BA |

*Primary Examiner*—E. S. Jackmon

*Attorney, Agent, or Firm*—Robert E. Burns; Emmanuel J. Lobato; Bruce L. Adams

[57] ABSTRACT

A small sized electric timepiece movement has a radius which is less than the diameter of the battery which powers the movement. Hence, the battery extends from one side of the movement to a point beyond the center-line of the timepiece. Advantage is taken of the fact that the battery is dome-shaped so as to accommodate a portion of the base plate which rotatably supports the cannon pinion and hour wheel of the timepiece movement which are located centrally of the timepiece. Hence, the axis of the cannon pinion and hour wheel, if projected, would intersect the battery. The invention enables the construction of an electronic timepiece which is smaller than would otherwise be possible. With a battery having a diameter of 7.9 mm and a thickness of 3.5 mm, it is possible to make a timepiece having a diameter of 14.8 mm and a thickness of about 4 mm.

2 Claims, 1 Drawing Figure

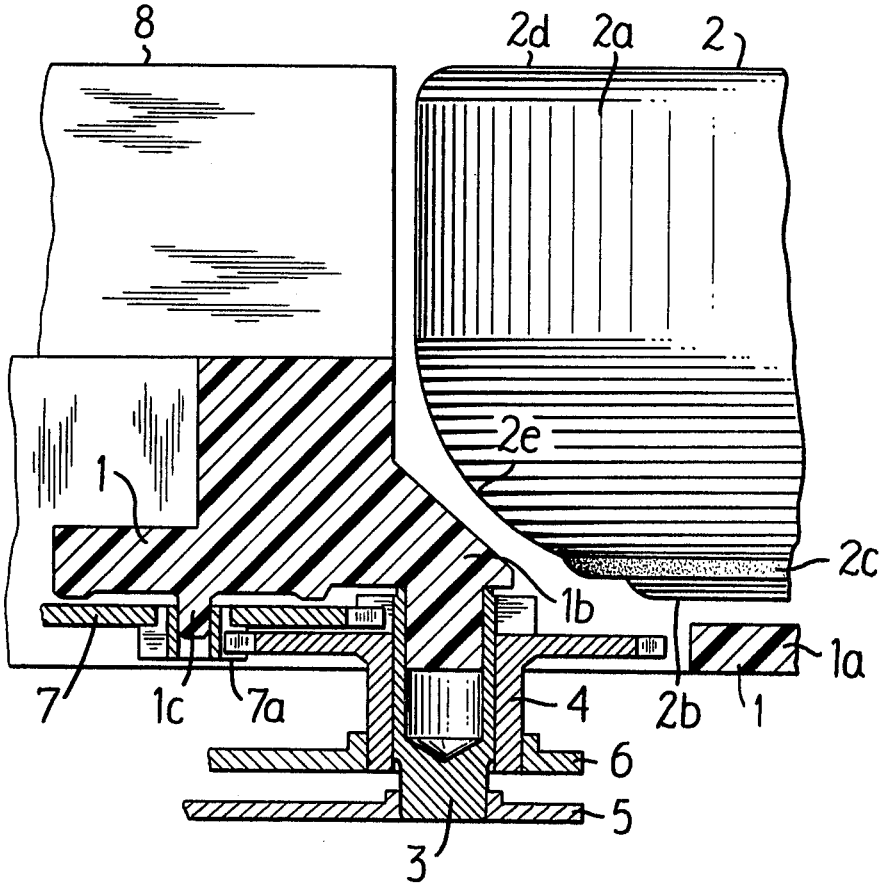
8
2d
2a
2
2e
1
2c
1b
1a
7
1c
7a
4
2b
1
6
5
3

SMALL SIZED ELECTRONIC TIMEPIECE MOVEMENT

FIELD OF INVENTION

The present invention relates to electronic timepieces and particularly to a construction enabling the production of small sized, thin timepieces.

BACKGROUND OF INVENTION

According to the conventional construction of an electronic timepiece using hands for indicating the time rather than a digital display, the battery for powering the timepiece must be located at one side of the shafts for the minute and hour hands which are centrally located. Hence, the diameter of the timepiece movement must be more than twice the diameter of the battery. The smallest battery presently available for use in timepieces is 7.9 mm in outer diameter. With conventional construction, the diameter of an electronic timepiece movement using such a battery is about 20 mm. If it is desired to make a smaller timepiece, the battery must protrude from the outer circumference of the timepiece movement. It is hence impossible to make a timepiece of small size even if the timepiece movement is small because the case must be made large enough to cover the protruding battery.

On the other hand, if a movement is made small sized, it is necessary to make it thicker in order to accommodate a battery inside the outer circumference of the movement. Hence the timepiece cannot be made thin. For example, if the timepiece movement is made approximately 15 mm in diameter it must be about 13 mm thick.

SUMMARY OF INVENTION

It is an object of the present invention to overcome the aforementioned disadvantages of conventional electronic timepieces and to provide an electronic timepiece which is both of small diameter and also thin. This is achieved by taking advantage of the dead space which results from the battery being somewhat dome-shaped with a relatively large circular base and a receding top portion of progressively smaller diameter. In accordance with the invention, a portion of the base plate which rotatably supports the cannon pinion and hour wheel of the watch is accommodated in this dead space so that the battery can extend from one side of the timepiece movement to a point beyond the centerline without interfering with the centrally located cannon pinion and hour wheel. It is hence possible to make an electronic timepiece movement having a diameter which is less than twice the diameter of the battery and a thickness which is only slightly more than the thickness of the battery.

BRIEF DESCRIPTION OF DRAWING

The nature, objects and advantages of the invention will be more fully understood from the following description of a preferred embodiment of the invention shown by way of the example in the accompanying drawing of which the single FIGURE is an enlarged and somewhat schematic partial cross section of a timepiece movement in accordance with the invention.

DESCRIPTION OF PREFERRED EMBODIMENT

An electronic timepiece movement in accordance with the present invention as illustrated by way of example in the drawing comprises a base plate 1 which is at the front of the movement and is conveniently molded of synthetic resin or other suitable plastic material. The bae plate 1 is recessed to accomodate a battery 2 composed of an anode case 2*a*, a cathode terminal 2*b* and an insulating ring 2*c*. The battery 2 is circular and somewhat dome-shaped with a generally flat base 2*d* and a receding top portion 2*e* of progressively decreasing diameter, the cathode terminal 2*b* being located at the top of the dome. The battery is located in the watch movement with the terminal 2*b* facing a relatively thin recessed portion 1*a* of the base plate 1 and with its base 2*d* approximately flush with the back surface 8 of the watch movement. The terminal 2*b* of the battery electrically contacts a contact of the circuitry of the electronic timepiece movement provided on the base plate or interposed between the base plate and the battery. The battery is held in place by the timepiece case, a suitable clip provided on the timepiece movement or other suitable retaining means (not shown).

A cannon pinion 3 is rotatably supported centrally of the timepiece by a portion 1*b* of the base plate 1. A minute hand 5 is mounted at the outer end of the common pinion 3. An hour wheel 4 is rotatable about the cannon pinion 3 and is coaxial therewith. An hour hand 6 is mounted on an outwardly extending hub portion of the hour wheel 3. The cannon pinion 3 and hour wheel 4 are driven by a minute wheel 7 which is rotatably supported by a portion 1*c* of the base plate 1. The minute wheel 7 has teeth at its periphery which engage teeth of the cannon pinion 3 and further has a unitary pinion portion 7*a* which engages teeth of the hour wheel 4. The minute wheel 7 is driven in conventional manner by the timepiece movement. The cannon pinion 3 and hour wheel 4 are concentric with the movement and with the timepiece case (not shown).

With the construction in accordance with the invention the battery 2 extends from one side of the timepiece movement to a point beyond the centerline of the movement. Although the battery extends beyond the centerline, the portion 1*b* of the base plate 1 which supports the centerally located cannon pinion 3 and hour wheel 4 is accommodated in the dead space resulting from the fact that the battery is somewhat dome-shaped with a receding portion 2*e* of progressively decreasing diameter. As will be seen from the drawing, the axis of the cannon pinion 3 and hour wheel 4 would intersect the battery if projected. It is thus possible in accordance with the invention to make an electronic timepiece movement having a diameter which is less than twice the diameter of the battery.

When the smallest battery presently available for electronic timepieces is used, i.e. a battery having an outer diameter of 7.9 mm and a thickness of 3.5 mm and assuming that the battery extends 0.5 mm beyond the centerline of the timepiece movement, the outer diameter of the timepiece movement is calculated as follows:

$$(7.9 - 0.5) \times 2 = 14.8 \text{ mm}$$

Since a thickness of 0.3 - 0.4 mm is sufficient for the thickness of the recessed portion 1*a* of the base plate 1 to support the lower portion of the battery 2 and since the battery extends from the base plate 1 to the back of the timepiece movement, the total thickness of the timepiece can be about 4 mm. The battery thus occupies approximately 80% - 90% of the thickness of the timepiece movement. It is thus possible in accordance with the present invention, when using a battery with an outer diameter of 7.9 mm and a thickness of 3.5 mm to make a timepiece which is approximately 15 mm in diameter and 4 mm thick.

In accordance with the conventional construction, using the same size battery, the electronic timepiece must be about 20 mm in diameter as pointed out above or alternatively must be about 13 mm thick. In contrast with the prior construction, the present invention makes it possible to construct an electronic timepiece which is of small diameter and is also thin.

While a preferred embodiment of the invention has been illustrated in the drawings and is herein particularly described, it will be understood by those skilled in the art that many variations and modifications can be made and that the invention is accordingly in no way limited to the illustrated embodiment.

What we claim is:

1. In an electronic timepiece, a timepiece movement comprising a base plate at the front of the movement, a cannon pinion rotatably supported by a portion of said base plate concentrically with the centerline of the timepiece, a minute hand mounted on said cannon pinion, an hour wheel mounted for rotation coaxially with said cannon pinion, an hour hand mounted on said hour wheel, means for driving said cannon pinion and hour wheel, and a battery for powering said timepiece, said battery having a dome-shaped case with a flat base and a receding top portion with a terminal at the top of the dome, means mounting said battery in the timepiece movement with said terminal at the top of said dome toward said base plate, said battery having a diameter greater than the radius of the movement and being mounted so as to extend radially inwardly from one side of the movement to a point beyond the centerline of the timepiece and to extend axially from said base plate to the back of the timepiece movement, said base plate being recessed to receive the battery and the portion of said base plate rotatably supporting said cannon pinion being accommodated in the space provided by said receding top portion of said battery.

2. A timepiece movement according to claim 1, in which the battery occupies approximately 80% - 90% of the thickness of the timepiece movement.

* * * * *